US005498113A

United States Patent [19]

Del Fabro et al.

[11] Patent Number: 5,498,113

[45] Date of Patent: Mar. 12, 1996

[54] METHOD TO BUTT BARS, AND BAR BUTTING ASSEMBLY THAT EMPLOYS SUCH METHOD

[75] Inventors: Giorgio Del Fabro, Cassacco-Fraz.Montegnacco; Marcello Del Fabro, Udine, both of Italy

[73] Assignee: M.E.P. Macchine Elettroniche Piegatrici SpA, Reana Del Rojale, Italy

[21] Appl. No.: 250,428

[22] Filed: May 27, 1994

[30] Foreign Application Priority Data

Jun. 25, 1993 [IT] Italy ..... UD93A0122

[51] Int. Cl.[6] ..... B23Q 5/00

[52] U.S. Cl. ..... 414/14; 198/468.2

[58] Field of Search ..... 414/746.8, 14, 414/18; 198/468.2; 82/127

[56] References Cited

U.S. PATENT DOCUMENTS

| | | | |
|---|---|---|---|
| 3,911,770 | 10/1975 | Boden . | |
| 4,628,779 | 12/1986 | Louis | 414/14 X |
| 4,638,693 | 1/1987 | Sugimoto | 414/14 X |
| 4,681,210 | 7/1987 | Miki et al. . | |

FOREIGN PATENT DOCUMENTS

| | | | |
|---|---|---|---|
| 2205386 | 5/1974 | France | B21D 43/20 |
| 3443754 | 6/1986 | Germany | B21S 43/00 |

*Primary Examiner*—Donald W. Underwood

*Attorney, Agent, or Firm*—Antonelli, Terry, Stout & Kraus

[57] ABSTRACT

Butting assembly and butting method employing the same to butt a single bar (11) or to butt a bundle of bars (11) by butting the single bars (11), the assembly being installed upstream of a processing machine, the bars (11) being fed one by one by hand or automatically to the butting assembly, which comprises a trolley (12) capable of to-and-fro alternating motion and able to move along a guide (13) extending lengthwise along the axis of the bar (11), the trolley (12) including at its upstream end gripper means (15) and at its downstream end abutment plate means (14) on the same axis as the bar (11), the abutment plate means (14) being kept resiliently in an inactive position and cooperating directly with position detection means (16) associated with an assembly (17) that manages and controls the butting assembly (10), the extreme positions of the trolley (12) being defined on the guide (19) by two end-of-travel stops (19), which are an upstream end-of-travel stop (**19*a*) and a downstream end-of-travel stop (19*b*) respectively, the downstream end-of-travel stop (19*b*) actuating the gripper means (15**) for opening and release.

3 Claims, 2 Drawing Sheets

METHOD TO BUTT BARS, AND BAR BUTTING ASSEMBLY THAT EMPLOYS SUCH METHOD

BACKGROUND OF THE INVENTION

This invention concerns a method to butt bars. The invention concerns also a butting assembly which employs such method. The bar butting assembly according to the invention is applied advantageously in cooperation with, and upstream of, machines fed with a bar or a bundle of bars, such as bending machines or machines to shear bars into segments of a pre-set length, for instance.

The machines have the purpose of producing accurately bent stirrups and bars and especially stirrups and bent bars for building work; the machines are therefore especially suitable for processing round bars for building work with a smooth outer surface or with ridges to accentuate fixture in concrete.

Various types of assembly to butt bars are disclosed in the state of the art. FR-A-2.472.523 discloses a bending machine which includes butting and lengthwise feeding means consisting of a thrust block, which is thrust against the trailing end of a bundle of bars so as to make the leading end of the bars cooperate with an abutment stop.

This machine does not ensure a correct butting of the bars inasmuch as it causes the trailing ends of a bundle of bars to be aligned but, owing to the length of the bars not being always constant but being affected by the tolerances of the operation of shearing the bars to size, does not ensure a correct butting of the leading ends of the bars. FR-A-2.340.152 discloses a device to feed bars lengthwise, whereby the butting is performed by engaging the bar and feeding it lengthwise, by a winch for instance, until the leading end of the bar has been brought into contact with an abutment plate suitably arranged beforehand in the required position. This system requires that the feeding means should pre-arrange the bars one by one in the shearing position and should therefore have a considerable travel, which will vary according to the length of the bars to be produced.

EP-A-0.188.850 arranges that a bundle of unbutted bars clamped by longitudinally movable gripper means is fed forwards until it cooperates with an abutment plate actuated by a piston; this plate has a first advanced position and a second retracted position. The leading end of the bar in its advanced position cooperates with the abutment plate and displaces the plate from its first advanced position to its second retracted position.

The gripper is then opened to free the bundle and retreats to its starting position, while the piston is actuated to bring the abutment plate to its first advanced position.

The abutment plate then brings the bars forwards again and butts them. This operation is repeated even with a great number of cycles.

This system entails the drawback that there are no checks to ensure that the whole bundle has been properly butted, and a machine operator has to be present to control the correct butting of the bundle of bars visually, thus increasing the costs of the operation.

To eliminate the presence of the machine operator, a cycle can be arranged whereby the butting operation is repeated automatically a great number of times, which can be determined as required.

But this solution not only does not provide an absolute assurance of correct butting of the bundle of bars but also leads to a great lengthening of the butting cycle and requires a consumption of energy greater than that strictly necessary and therefore increases the costs of the butting operation. U.S. Pat. No. 3,911,770 concerns a cutting machine to cut small segments, one at a time and all of the same length; from a smooth, gauged bar; it therefore does not concern a butting assembly which prepares butted bars or bundles of bars for a shearing machine or bending machine.

The cutting machine of this prior art document includes a bar feeder to position the leading end of the bar beyond the cutting means so as to make that end cooperate with an abutment stop, the pre-set distance of which from the cutting means determines the length of the segments to be cut. The segments are then removed by means of a chute after the abutment stop has of necessity been temporarily disactivated. The removal is made possible by two accompanying factors, the disactivation of the abutment stop and the feed of the bar. This teaching can be used only with small pieces of material having a constant and accurate cross-section in one single bar.

FR-A-2.205.386 includes a trolley able to move parallel to the axis of feed of bars and equipped with grippers to engage the single bar to be butted.

The trolley has a rear end-of-travel stop which can be positioned as required and the contact of which with the trolley causes disactivation of the motor of the trolley and therefore the halting of the trolley and the shearing. In this position the engagement grippers open and let the bar fall.

The butting can therefore never be accurate since the distance from the end of the bar to the point of engagement of the grippers is not the same for all the bars, so that the bars are in fact not butted precisely.

SUMMARY OF THE INVENTION

The present applicants have designed, tested and embodied this invention to overcome the shortcomings of the state of the art and to achieve further advantages.

The butting assembly according to the invention enables one single bar to be correctly butted at a time and, when correctly butted, to be positioned at a pre-set point.

The bar fed to the butting assembly according to the invention cooperates with supporting means which have a first working position, in which they support the bar being fed, and a second inactive position, in which they do not interact with the bar but allow it to fall.

The butting device according to the invention enables a bundle of bars to be assembled which has all the bars properly butted with great accuracy and superimposed, for instance, one on another.

The bundle of bars can cooperate thereafter, for instance, with a shearing assembly or bending assembly located downstream.

The butting assembly according to the invention comprises gripper means fitted to a gripper-bearing trolley able to move lengthwise with a to-and-fro alternating movement along the axis of the bar to be butted. This gripper-bearing trolley can move on a stationary guide extending parallel to the axis of the bar.

This guide includes at least one upstream end-of-travel stop and one downstream end-of-travel stop, which are stationary or can be fixed as desired and delimit the travel of the gripper-bearing trolley.

The gripper means have an engagement position, in which they cooperate with the bar to be butted and clamp the same, and a release position, in which they do not interact with the bar.

In the description that follows we shall use the following terminology:

"advance" shall mean movement of the trolley in the direction of downstream feed of the bar to be butted;

"retreat" shall mean movement of the trolley in the direction opposite to the direction of downstream feed of the bar to be butted;

"upstream" shall indicate what encounters the leading end of the bar first;

"downstream" shall indicate what encounters the leading end of the bar last.

In a position downstream of the gripper means, the movable trolley includes abutment plate means kept in an inactive position by resilient means and able to move in relation to the trolley on a plane which contains substantially the axis of advance of bars.

The travel of the abutment plate means is limited so as to obviate incorrect butting operations.

Means to detect the position of the leading end of the bar cooperate with the abutment plate means and consist, for instance, of a microswitch, which detects when the leading end of the bar comes into contact with the abutment plate means and displaces the latter from their inactive position.

These position detection means are connected to an assembly that manages and controls the butting assembly and, when they are actuated, on the one hand cause automatic closure of the gripper means to clamp the bar in that position and on the other hand send a signal that brings the bar supporting means to a disactivated position, thus freeing the bar from its support.

The gripper bearing trolley during its movement of transfer has substantially two determined positions as follows:

an upstream end-of-travel position beyond which it cannot pass in its movement of retreat;

a downstream end-of-travel position which determines the point at which the gripper means are opened and free the bar.

The butting method which the butting assembly according to the invention performs is as follows:

the manual or automatic feed of a bar to the butting assembly according to the invention; the bar is supported on its lower side by, but is free to slide axially on, supporting means kept in a working position;

the retreat of the movable trolley, with the gripper means in their release position, from the downstream end-of-travel stop towards the upstream end-of-travel stop; two alternative situations may now arise as follows:

A) If the leading end of the bar contacts the abutment plate means, the position detection means, being actuated by that leading end, cause closure of the gripper means, which clamp the bar in a given determined position and disactivate the supporting means, which move to their position of non-contact with the bar;

the trolley now advances and carries the bar until the trolley cooperates with the downstream end-of-travel stop; here the gripper means open and release the correctly butted bar, which falls into the space below where the bundle of butted bars is being formed;

the bar supporting means are then re-positioned in their working position for the next butting cycle;

B) If the leading end of the bar does not contact the abutment plate means, the gripper means close when the trolley reaches the upstream end-of-travel stop, and clamp the bar in an undefined position;

the trolley advances to the downstream end-of-travel stop, where the gripper means open and release the bar in an undefined position, the bar being still upheld by the supporting means in their working position;

the movable trolley with the gripper means in their release position retreats again from the downstream end-of-travel stop towards the upstream end-of-travel stop;

the above two alternative situations A and B respectively, may now arise again;

if A arises, the butting operation ends with the release of the butted bar at the downstream end-of-travel stop;

if situation B arises, the operation is repeated until the situation A takes place.

We say "theoretical" because, if case B occurs again, this would mean that the distance between the abutment plate and the gripper on the trolley is greater than the distance between the two end-of-travel stops, and this is in fact impossible.

The butting assembly according to the invention and, in particular, the actuation of the movable trolley, the gripper means and the supporting means are controlled advantageously by a management and control assembly of a programmable type, for instance, to which the signal generated by the position detection means comes.

The end-of-travel stops in the butting assembly according to the invention may be of a mechanical or electrical or another type and may be capable of being programmed by the management and control assembly.

Lateral guide means may cooperate with the butting assembly according to the invention and may be positioned below the same so as to define a channel of a suitable width, within which the bars are deposited and superimposed on each other to form a correctly butted bundle.

The butted bars, or the bundle of butted bars thus produced, are caused to cooperate, for instance, with a downstream shears or bending assembly.

BRIEF DESCRIPTION OF THE DRAWINGS

The attached figures are given as a non-restrictive example and show a preferred lay-out of the invention as follows.

DETAILED DESCRIPTION OF THE PREFERRED EMBODIMENTS

Figure 1:
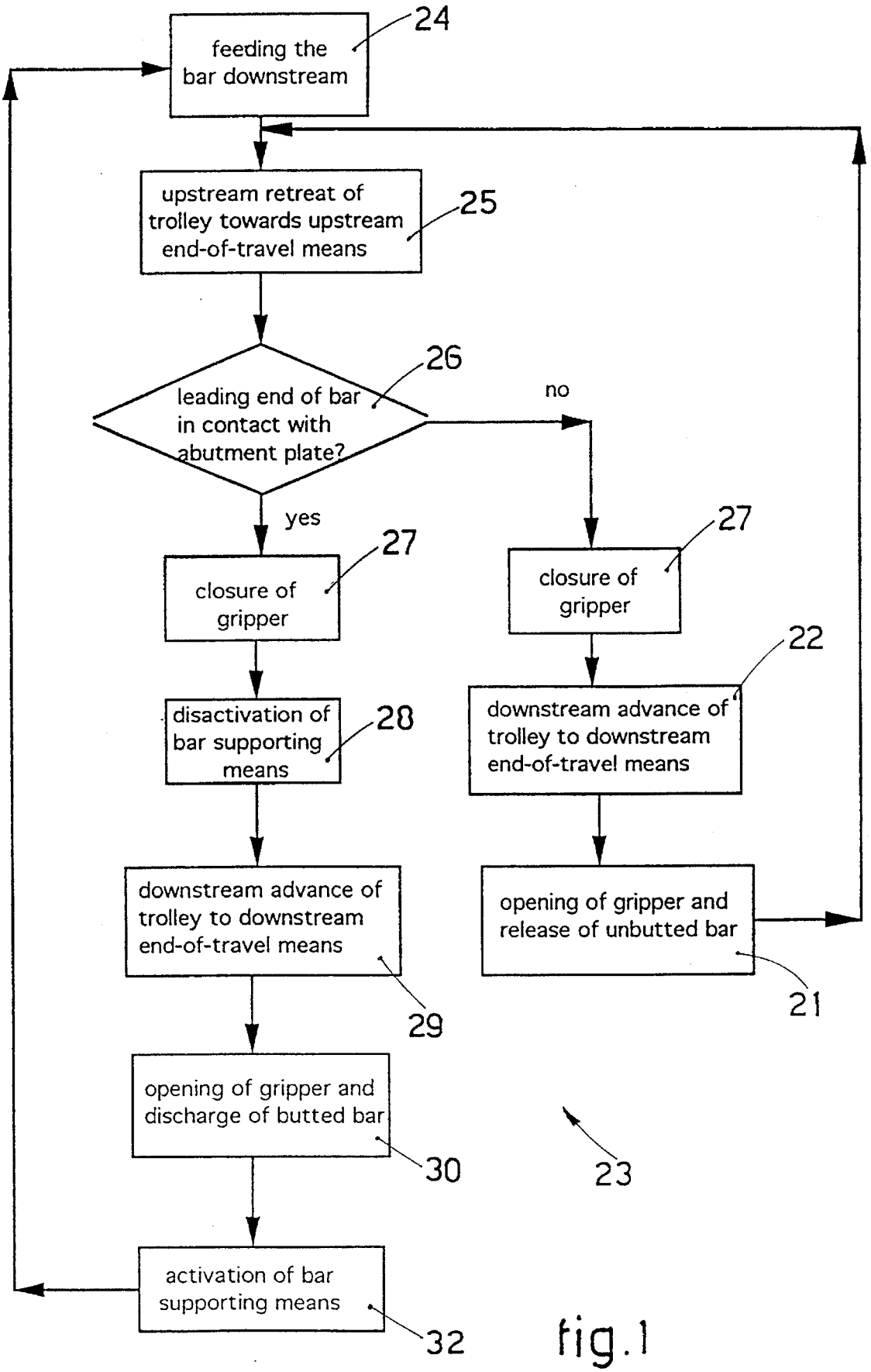
FIG. 1 is a block diagram of a possible working cycle of the butting assembly according to the invention.

The reference number 10 in the attached figures denotes generally an assembly to butt bars 11 according to the invention.

According to the invention supporting means 31 on which a bar 11 being fed is upheld are included upstream of the butting assembly 10.

These supporting means 31 have a first working position 31*a*, in which they support and cooperate with the bar 11, and a second non-contact position 31*b*, of a retracted type for instance, in which they are disengaged from the bar 11 and leave it free to fall.

The butting assembly 10 according to the invention comprises a trolley 12 able to move lengthwise with a to-and-fro alternating motion along a guide 13 positioned on the same axis as the direction of feed of the bar 11 to be butted.

The trolley 12 includes in its downstream end abutment plate means 14, which are kept resiliently thrust, by a spring 18 in this case, towards the upstream side of the trolley 12, where gripper means 15 to engage the bar 11 are located.

Position detection means 16 are associated with the abutment plate means 14 and consist, for instance, of a microswitch connected to an assembly 17 which manages and controls the butting assembly 10.

The guide 13 provides two stationary positions or positions which can be located as desired, namely:

an upstream end-of-travel stop 19*a* beyond which the trolley 12 cannot be positioned in its movement of retreat in the opposite direction to the direction of feed of the bar 11;

and a downstream end-of-travel stop 19*b* which determines the point where the trolley 12 halts to free the bar 11 from the gripper means 15.

The upstream and downstream end-of-travel stops 19*a*–19*b* respectively can be of a stationary type and may consist, for instance, of abutment elements 20 forming part of, or solidly fixed to, the guide 13 on which the trolley 12 slides (see FIGS. 2*a*–2*f*.

According to a variant the respective upstream 19*a* and downstream 19*b* end-of-travel stops can be defined by means of electrical contacts or through software by means of the management and control assembly 17, which controls the lengthwise movements of the trolley 12 along the guide 13.

Figure 2A:
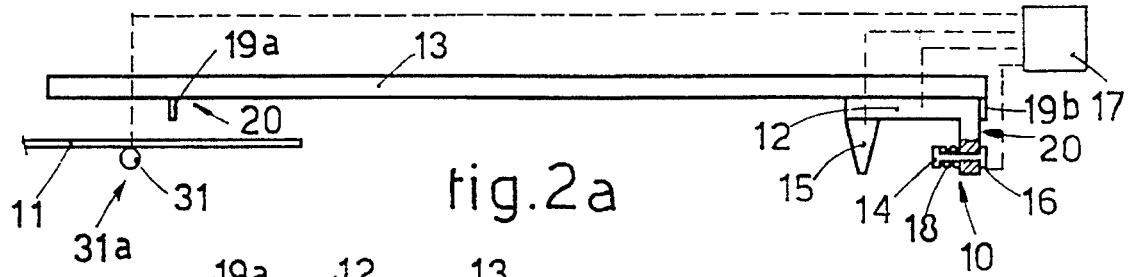
FIGS. 2*l*–2*f* are diagrams of the various steps of butting a bar with the butting assembly according to the invention.

The bar 11 to be butted is fed by hand or automatically to the butting assembly 10 according to the invention and cooperates with the supporting means 31 in their working position 31*a* (FIG. 2*a*).

Thereafter the trolley 12 is caused to retreat upstream with the gripper means 15 in their open position.

If the leading end of the bar 11 during this retreat of the trolley 12 comes into contact with the abutment plate means 14 (FIG. 2*b*), the position detection means 16 associated with the abutment plate means 14 send a signal to the management and control assembly 17, which causes closure of the gripper means 15 to clamp the bar and at the same time brings the supporting means 31 to their non-contact position 31*b*.

The trolley 12 then advances until it reaches the downstream end-of-travel stop 19*b*, where the gripper means 15 are opened and release the correctly butted bar 11 (FIG. 2*c*), which falls as it is no longer upheld by the supporting means 31.

Figure 2B:
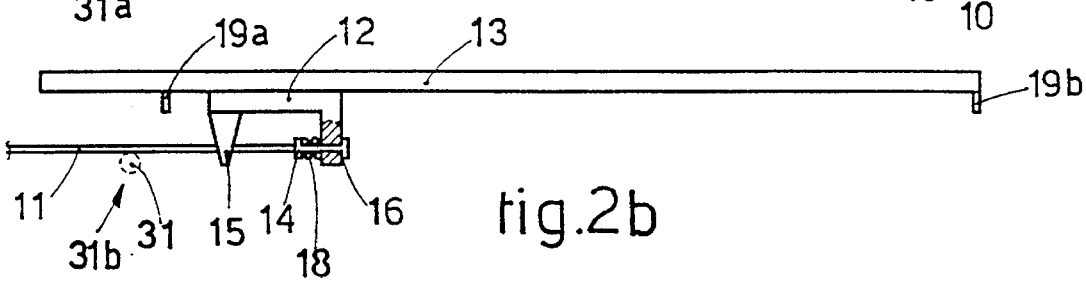
Figure 2C:
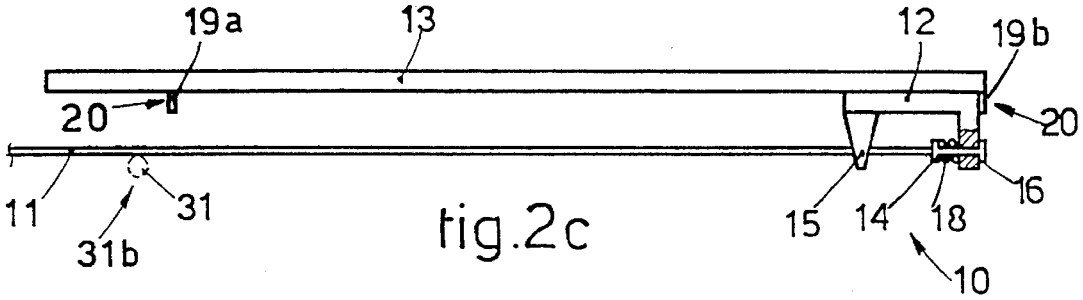
Figure 2D:
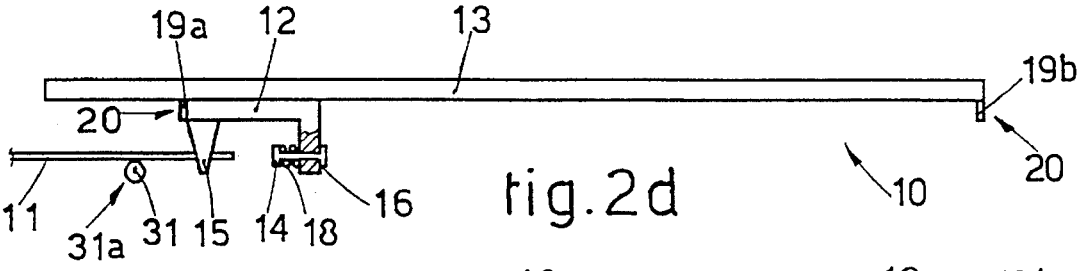

If the abutment plate means 14 do not encounter the leading end of the bar 11 during the upstream retreat of the trolley 12, the trolley 12 is caused to retreat until it cooperates with the upstream end-of-travel stop 19*a* (FIG. 2*d*).

Next, the gripper means 15 are closed to clamp the bar 11 and the trolley 12 advances until it cooperates with the downstream end-of-travel stop 19*b*, where the gripper means 15 are opened to free the bar 11 (FIG. 2*e*), which remains upheld on the supporting means 31 in their working position 31*a*.

Figure 2E:
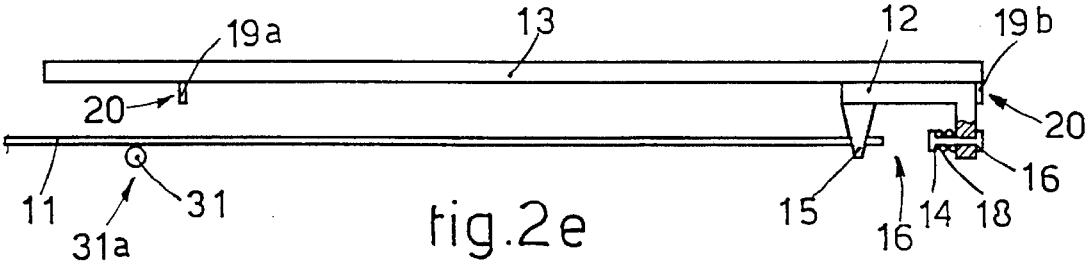
Figure 2F:
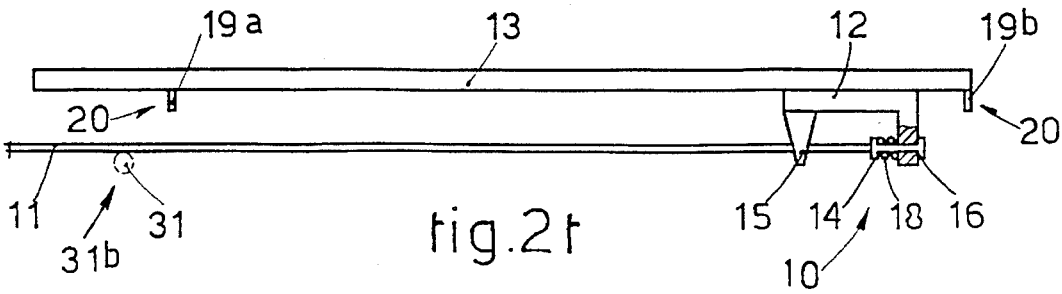

The trolley 12 is then caused to retreat with the gripper means 15 in their open position, and the above cycle is repeated until the leading end of the bar 11 comes into contact with the abutment plate means 14, thus actuating the position detection means 16 (FIG. 2*f*).

The movement of the trolley 12, the opening and closing of the gripper means 15 and the actuation of the supporting means 31 can be brought about, for instance, by piston means or other analogous means of a known type, which are not shown here as they are not important for the purposes of the invention.

FIG. 1 shows with a block diagram a possible sequence of a butting method 23 according to the invention, which comprises the following steps:

24—feeding a bar 11 downstream to be butted (FIG. 2*a*);

25—upstream retreat of the trolley 12 with the gripper means 15 in their open position;

26—checking whether the leading end of the bar 11 has contacted the abutment plate means 14;

A)—if the answer to step 26 is yes;

27—closure of the gripper means 15 (FIG. 2*b*);

28—disactivation of the bar supporting means 31, which move from their working position 31*a* to their disactivated position 31*b;*

29—advance of the trolley 12 to the downstream end-of-travel stop 19*b* with the bar 11 clamped by the gripper means 15 (FIG. 2*c*);

30—opening of the gripper means 15 with the resulting discharge of the butted bar 11;

32—activation of the supporting means 31;

B)—if the answer to step 26 is no (FIG. 2*d*):

27—closure of the gripper means 15;

22—advance of the trolley 12 to the downstream end-of-travel stop 19*b* with the bar 11 clamped by the gripper means 15 (FIG. 2*e*);

21—opening of the gripper means 15 with the resulting release of the unbutted bar 11, which remains upheld by the supporting means 31 in their working position 31*a;*

25—retreat of the trolley 12 towards the upstream end-of-travel stop 19*a* and repetition of the cycle from step 26 onwards.

We claim:

1. A butting assembly to butt a single bar or to butt a bundle of bars by butting single bars of which the bundle is comprised, the assembly being installed upstream of a processing machine, the bars being fed one by one to the butting assembly, which comprises a guide extending lengthwise along the axis of the bar and having upstream and downstream end of travel stops; a trolley capable of to-and-fro alternating motion and able to move along the guide, the trolley comprising a gripper positioned at the upstream end of the trolley and an abutment plate positioned on resilient means at the downstream end of the trolley, the gripper and abutment plate being on the same axis as the bar; a position detector operably connected to the abutment plate; and an assembly for managing and controlling the butting assembly, the abutment plate being kept resiliently in an inactive position and cooperating directly with the position detector which is operably connected with the assembly that manages and controls the butting assembly, the extreme positions of the trolley being defined on the guide by the upstream end-of-travel stop and the downstream end-of-travel stop, respectively, the downstream end-of-travel stop actuating the gripper for opening and release.

2. The butting assembly as in claim 1, which comprises supporting means provided adjacent to the guide to support the bar being fed, the supporting means having a working position supporting the bar and an inactive position disengaged from the bar.

3. A butting method which employs a butting assembly comprising a guide extending lengthwise along the axis of the bar and having upstream and downstream end of travel stops; a trolley capable of to-and-fro alternating motion and able to move along the guide, the trolley comprising a gripper positioned at the upstream end of the trolley and an abutment plate positioned on resilient means at the downstream end of the trolley, the gripper and abutment plate being on the same axis as the bar; a position detector operably connected to the abutment plate; an assembly for managing and controlling the butting assembly, the abutment plate being kept resiliently in an inactive position and cooperating directly with the position detector which is operably connected with the assembly that manages and controls the butting assembly, the extreme positions of the trolley being defined on the guide by the upstream end-of-travel stop and the downstream end-of-travel stop, respectively, the downstream end-of-travel stop actuating the gripper for opening and release; and supporting means provided adjacent to the guide to support the bar being fed, the supporting means having a working position supporting the bar and an inactive position disengaged from the bar; and comprises the following steps:

feeding a bar to be butted which is upheld on the supporting means in its working position;

moving the trolley upstream;

checking whether there is contact between the leading end of the bar and the abutment plate;

if there is contact between the leading end of the bar and the abutment plate, closing the gripper, moving the supporting means into its inactive position, advancing the trolley, with the bar clamped by the gripper, to a downstream end-of-travel stop, opening of gripper thereby discharging the butted bar and activating the supporting means;

if there is no contact between the leading end of the bar and the abutment plate, closing the gripper advancing the trolley, with the bar clamped by the gripper, to a downstream end-of-travel stop, opening the gripper thereby releasing the unbutted bar, which remains upheld by the supporting means in its working position, moving the trolley upstream, and again checking whether there is contact between the leading end of the bar and the abutment plate.

* * * * *